US011819120B2

(12) United States Patent
Baruch et al.

(10) Patent No.: US 11,819,120 B2
(45) Date of Patent: Nov. 21, 2023

(54) AUTOMATIC LOCKING MECHANISM AND WORKTABLE

(71) Applicant: The Stanley Works Israel Ltd., Rosh Ha'Ayin (IL)

(72) Inventors: Danny Baruch, Lapid (IL); Noam Twig, Petach Tikva (IL); Nir Fridman, Matan (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 0 days.

(21) Appl. No.: 17/653,970

(22) Filed: Mar. 8, 2022

(65) Prior Publication Data

US 2022/0304461 A1 Sep. 29, 2022

(30) Foreign Application Priority Data

Mar. 25, 2021 (EP) ..... 21165075

(51) Int. Cl.
*A47B 3/08* (2006.01)
*A47B 3/087* (2006.01)

(52) U.S. Cl.
CPC ..... *A47B 3/0809* (2013.01); *A47B 3/087* (2013.01)

(58) Field of Classification Search
CPC ..... A47B 3/087; A47B 3/0809
USPC ..... 108/167, 168, 171, 172
See application file for complete search history.

(56) References Cited

U.S. PATENT DOCUMENTS

| | | | | |
|---|---|---|---|---|
| 2,747,957 | A * | 5/1956 | Lencioni | A47B 3/087 108/36 |
| 2,803,033 | A * | 8/1957 | Rachman | A47B 3/087 16/326 |
| 7,172,053 | B2 | 2/2007 | Slavich | |
| 7,415,933 | B2 | 8/2008 | Sagol | |
| 7,640,870 | B2 | 1/2010 | Strong et al. | |
| 8,567,631 | B2 | 10/2013 | Brunner | |
| 2003/0167980 | A1 * | 9/2003 | Suzuki | A47C 4/20 108/133 |
| 2013/0233210 | A1 * | 9/2013 | Jin | A47B 3/0818 108/166 |
| 2014/0208992 | A1 * | 7/2014 | Cai | A47B 3/087 74/529 |

(Continued)

FOREIGN PATENT DOCUMENTS

| | | | |
|---|---|---|---|
| CN | 2935955 | Y | 8/2007 |
| CN | 202504566 | U | 10/2012 |

(Continued)

*Primary Examiner* — Matthew W Ing

(57) ABSTRACT

A locking mechanism is configured to automatically secure a first object to a second object when the objects are adjacent one another. The locking mechanism selectively releases the objects from one another in response to the movement of a third object. The locking mechanism includes a latch having a base, a pivoting portion attached to the base, with the pivoting portion configured to pivotally secure the latch to the first object about an axis (A). The latch also includes a securing portion attached to the base. A receiving surface is configured to contact the second object as it comes into proximity with the first object and pivot the latch about the axis (A) in a first direction. The securing portion also includes a hook configured to automatically secure the second object to the first object when the objects are adjacent to one another.

15 Claims, 8 Drawing Sheets

(56) References Cited

U.S. PATENT DOCUMENTS

| | | | | |
|---|---|---|---|---|
| 2017/0013955 | A1* | 1/2017 | Lin | A47B 3/087 |
| 2019/0090626 | A1 | 3/2019 | Leng | |
| 2019/0314975 | A1 | 10/2019 | Sun | |

FOREIGN PATENT DOCUMENTS

| | | | |
|---|---|---|---|
| CN | 204764109 | U | 11/2015 |
| CN | 106473446 | A | 3/2017 |
| CN | 107510231 | A | 12/2017 |
| CN | 208084294 | U | 11/2018 |
| DE | 20315186 | U1 | 12/2003 |

* cited by examiner

AUTOMATIC LOCKING MECHANISM AND WORKTABLE

CROSS-REFERENCE TO RELATED APPLICATIONS

This application claims priority, under 35 U.S.C. § 119, to EP Patent Application No. 21165075 filed Mar. 25, 2021.

FIELD OF THE INVENTION

The present invention relates to an automatic locking mechanism and a portable worktable utilizing the same

BACKGROUND

Typical locking mechanisms or latches require multiple steps to secure objects together. For example, when securing a portable worktable in its operable position, a user must first ensure that the latch does not obstruct the opening/deployment of the worksurface into its planar operating position. Once the worksurface is in its planar position, a user can then lock the portions of the worksurface to one another It is not unusual for the locking of a worktable into its operating position to be a multi-step process. Conversely, when breaking down a portable worktable, a user must undo all of those same steps in reverse.

It would be advantageous to have an automatic locking mechanism that automatically secures the portions of a worktable together as it being deployed. Likewise, it would be advantageous if that same automatic locking mechanism, unlocked the worktable more efficiently. The automatic locking mechanism of the present invention achieves or more of these advantages.

SUMMARY OF THE INVENTION

In a first aspect, the present invention discloses an automatic locking mechanism that is configured to automatically secure a first object to a second object when said first and second objects are adjacent one another. The automatic locking mechanism also selectively releases said first and second objects from one another in response to the movement of a third object. The automatic locking mechanism includes a latch having a base, a pivoting portion attached to the base, and wherein said pivoting portion is configured to pivotally secure the latch to the first object about an axis (A). The latch also includes a securing portion attached to the base. Said receiving surface being configured to contact the second object as it comes into proximity with the first object and pivot the latch about the axis (A) in a first direction. The securing portion also includes a hook configured to automatically secure the second object to the first object when said objects are adjacent to one another. The latch also includes a bias support attached to the base. Said bias support includes an arch that is configured to protrude into the first object and define as space between the first object and an interior apex of the arch. The latch further includes a cam structure attached to the base. Said cam structure includes a receiving surface that is configured to contact the third object and pivot the latch about the axis (A) in the first direction in response to the selective movement of the third object. The latch further includes a biasing mechanism positioned in the space between the first object and the interior apex of the arch. The biasing mechanism is configured to bias the latch toward pivoting about the axis (A) in a second direction that is opposite the first direction.

In another aspect, the present invention discloses a worktable having a worksurface. The worksurface includes a first portion and second portion each having a top and a plurality of walls that are substantially perpendicular to the top. The first portion and second portions are pivotally connected to one another about an axis (B) such that the worksurface is movable between a folded position, wherein the respective tops and plurality of walls are positioned to define an interior space, and an operable position, wherein the respective tops are positioned to form a single planar surface. The worktable further includes a plurality of legs. Each leg is movable between a support position, wherein the leg provides support for the worksurface in its operable position, and a stowed position, wherein the leg is confined within the interior space. The worktable is characterized in that it further includes an automatic locking mechanism configured to automatically secure the first portion and second portion together when the worksurface is moved into its operable position, and automatically release the first portion and second portion from one another in response to the movement of at least one leg from its support position to its stowed position.

These and other objects, features, and characteristics of the present invention will become more apparent upon consideration of the following description and the appended claims with reference to the accompanying drawings, all of which form a part of this specification, wherein like reference numerals designate corresponding parts in the various figures. It is to be expressly understood, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural references unless the context clearly dictates otherwise.

DETAILED DESCRIPTION OF EXEMPLARY EMBODIMENT

The invention provides an automatic locking mechanism that includes a latch and a biasing mechanism. The automatic locking mechanism enables a first object and a second object that are movable relative to one another to be secured together using a single motion. Further, the automatic locking mechanism releases the first and second objects from one another in response to the selective movement of a third object. For example, a portable worktable having a worksurface with a first portion and second portion that are pivotable to one another can be secured in an operable position, wherein the first and second portions of the worksurface combine to create a single planar surface. Conversely, when it is desired to break the worktable down, the automatic locking mechanism releases the first and second portions from one another in response to the movement of a leg from its support position to its stowed position.

Figure 1:
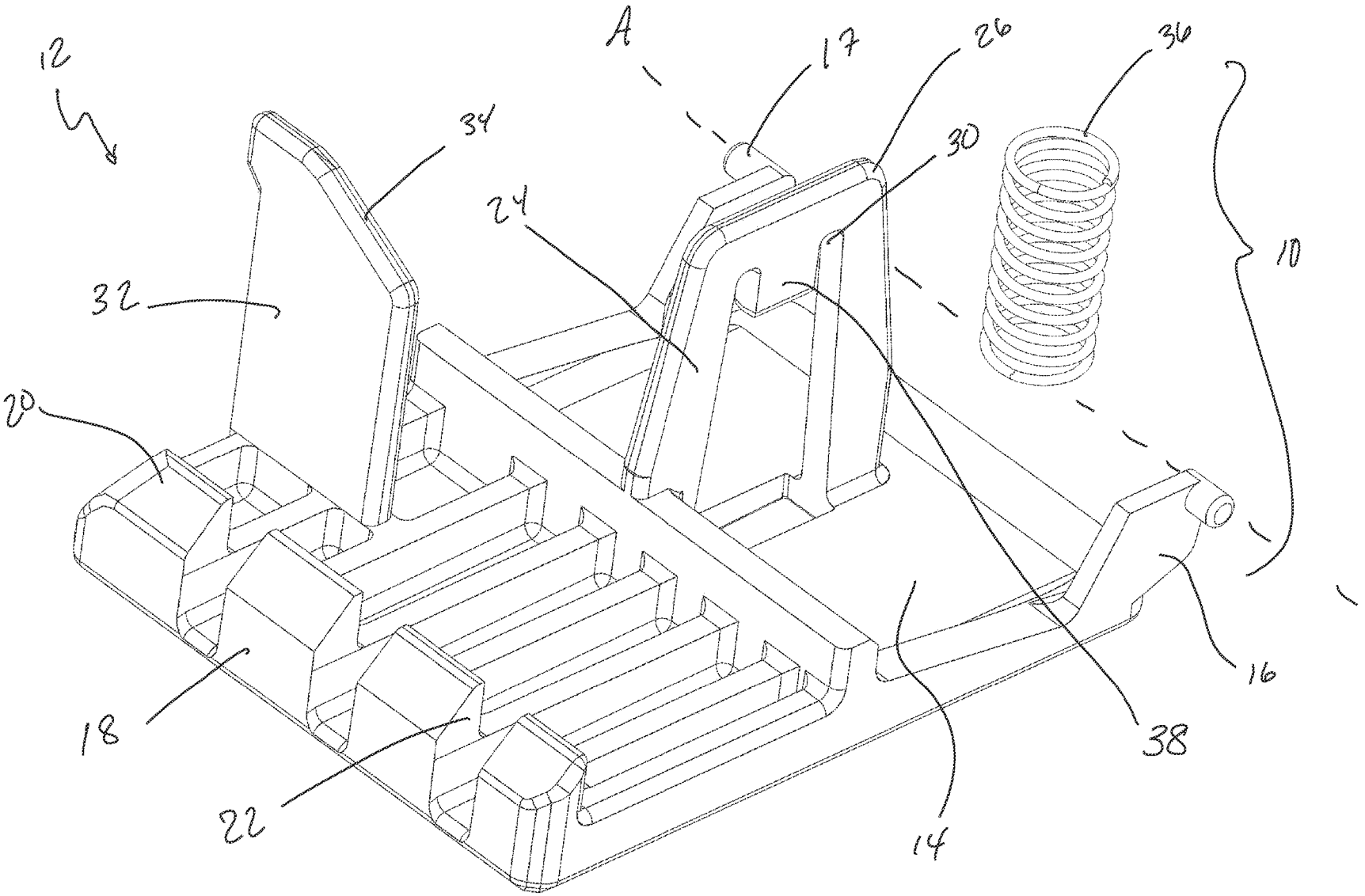
FIG. 1 is an exploded view of the automatic locking mechanism.

FIG. 1 illustrates an exploded view of the automatic locking mechanism 10 according to an embodiment of the invention. Automatic locking mechanism 10 includes a latch 12 and a biasing mechanism 36. Latch 12 includes a base 14, a pivoting portion 16, a securing portion, a bias support 24 and a cam structure 32.

The pivoting portion 16 is attached to the base 14 and is configured to pivotally secure the latch 12 to a first object about an axis (A). In a preferred embodiment, pivoting portion 16 may include a plurality of dowels 17. Dowels 17 are substantially cylindrical in shape and are configured to be received into corresponding openings in the first object. Axis (A) runs through the centers of dowels 17.

The securing portion 18 of the latch 12 is also attached to the base 14. The securing portion 18 includes a receiving surface 20 that is configured to contact a second object as it comes into proximity with the first object. When the second object contacts the receiving surface 20, the latch is pivoted about axis (A) in a first direction. In a preferred embodiment, receiving surface 20 may be a beveled surface. The securing portion 18 further includes a hook 22 that is configured to automatically secure the second object to the first object when said objects are adjacent to one another.

The bias support 24, which is also attached to the base 14, includes an arch 26. Arch 26 is configured to protrude into the first object and define a space 28 between the first object and an interior apex 30 of the arch 26.

The cam structure 32 is also attached to the base 14. The cam structure 32 includes a receiving surface 34 that is configured to contact the third object. In response to the selective movement of the third object, contact with the receiving surface 34 occurs. This contact causes the latch to pivot about axis (A) in the first direction. In a preferred embodiment, receiving surface 34 may be a beveled surface.

As stated above, the automatic locking mechanism 10 also includes a biasing mechanism 36. Biasing mechanism 36 is positioned in the space 28 between the first object and the interior apex 30 of the arch 26. Biasing mechanism 36 is configured to bias the latch 12 toward pivoting about the axis (A) in a second direction that is opposite the first direction. Those skilled in the art will recognize that the biasing mechanism 36 can be a coil spring or a leaf spring.

In a preferred embodiment, the bias support 24 may further include a bias guide 38. Bias guide 38 is configured to engage the biasing means 36 and guide its biasing function. As can be seen in FIG. 1, bias guide 38 may be a protrusion that extends away from the interior apex 30 of the arch 26.

The automatic locking mechanism 10 of the present invention can be used to secure any variety of objects together. One such example is a worktable 40 such as that depicted in FIGS. 2-7*b*. The worktable 40 includes a worksurface 42, a plurality of legs 56, and is characterized in that it further includes an automatic locking mechanism 10.

The worksurface 42 of worktable 40 includes a first portion 44 and a second portion 46. Each of the first and second portions include a top 48*a*, 48*b* and a plurality of walls 50*a*, 50*b*. For ease of reference, the demarcations of "a" and "b" respectively correspond to the first portion and the second portion. The plurality of walls 50*a*, 50*b* are substantially perpendicular to the tops 48*a*, 48*b*. The first portion 44 and second portion 46 are pivotally connected to one another about an axis (B) such that the worksurface 42 is movable between a folded position and an operable position. In the folded position, the tops 48*a*, 48*b* and plurality of walls 50*a*, 50*b* define an interior space. The best example of this folded position can be seen in FIG. 4. In the operable position, the respective tops 48*a*, 48*b* are positioned to form a singular planar surface 54. The best example of this operable position can be seen in FIG. 2.

As stated above, the worktable 40 also includes a plurality of legs 56. Each leg 56 is movable between a support position and a stowed position. In the support position, leg 56 provides support for the worksurface 42 in its operable position. In the stowed position, leg 56 is confined within the interior space. Those skilled in the art will recognize that legs 56 may be configured to be pivotable between their support and stowed positions.

The automatic locking mechanism 10 of worktable 40 is configured to automatically secure the first portion 44 and the second portion 46 together when the worksurface is pivoted into its operable position. The automatic locking mechanism 10 is also configured to automatically release the first portion 44 from the second portion 46 in response to the movement of at least one leg 56 from its support position to its stowed position.

The automatic locking mechanism 10 of worktable 40 will now be discussed in detail. Those skilled in the art will recognize that the stand-alone automatic locking mechanism 10 as described above, is identical to the automatic locking mechanism of worktable 40, with the exception that the first object, second object and third object of the stand-alone automatic locking mechanism 10 are respectively replaced with the first portion 44, second portion 46 and leg 56 of the worktable automatic locking mechanism 10. The automatic locking mechanism 10 of worktable 40 thus includes a latch 12 and a biasing mechanism 36. The latch 12 includes a base 14, a pivoting portion 16, a securing portion 18, a bias support 24 and a cam structure 32.

The pivoting portion 16 is attached to the base 14 and is configured to pivotally secure the latch 12 to the first portion 44 about an axis (A). In a preferred embodiment, pivoting portion 16 may include a plurality of dowels 17. Dowels 17 are substantially cylindrical in shape and are configured to be received into corresponding openings in the first portion 44. Axis (A) runs through the centers of dowels 17.

The securing portion 18 of the latch 12 is also attached to the base 14. The securing portion 18 includes a receiving surface 20 that is configured to contact the second portion 46 as it comes into proximity with the first portion 44. When the second portion 46 contacts the receiving surface 20, the latch 12 is pivoted about axis (A) in a first direction (CW). (For ease of reference, this first direction (CW) will hereinafter be described in relationship to its positioning in FIG. 7*b*. However, those skilled in the art will recognize that in operation, the direction of rotation CW or CCW is dependent on the physical orientation of the worktable.) In a preferred embodiment, receiving surface 20 may be a beveled surface.

The securing portion 18 further includes a hook 22 that is configured to automatically secure the second portion 46 to the first portion 44 when worksurface 42 is pivoted into its operable position. In a preferred embodiment, the hook 22 secures the second portion 46 to the first portion 44 by engaging an opening 58 defined in the second portion 46.

As stated above, the automatic locking mechanism 10 of worktable 40 also includes a bias support 24 that is also attached to the base 14. The bias support 24 includes an arch 26. Arch 26 is configured to protrude into the first portion 44 and define a space 28 between the first portion 44 and an interior apex 30 of the arch 26.

The cam structure 32 of the automatic locking mechanism 10 is also attached to the base 14. The cam structure 32 includes a receiving surface 34 that is configured to contact a leg 56. In response to the selective movement of leg 56, contact with the receiving surface 34 occurs. More specifically, this contact occurs when leg 56 is moved from its support position to its stowed position. The contact between the leg 56 and the receiving surface 34 causes the latch 12 to pivot about axis (A) in the first direction (CW). In a preferred embodiment, leg 56 may further include a cross bar 60, and the crossbar 60 is configured to engage the receiving surface 34 and cause the latch to pivot about axis (A) in the first direction (CW). In yet another preferred embodiment, receiving surface 34 may be a beveled surface.

Figure 7A:
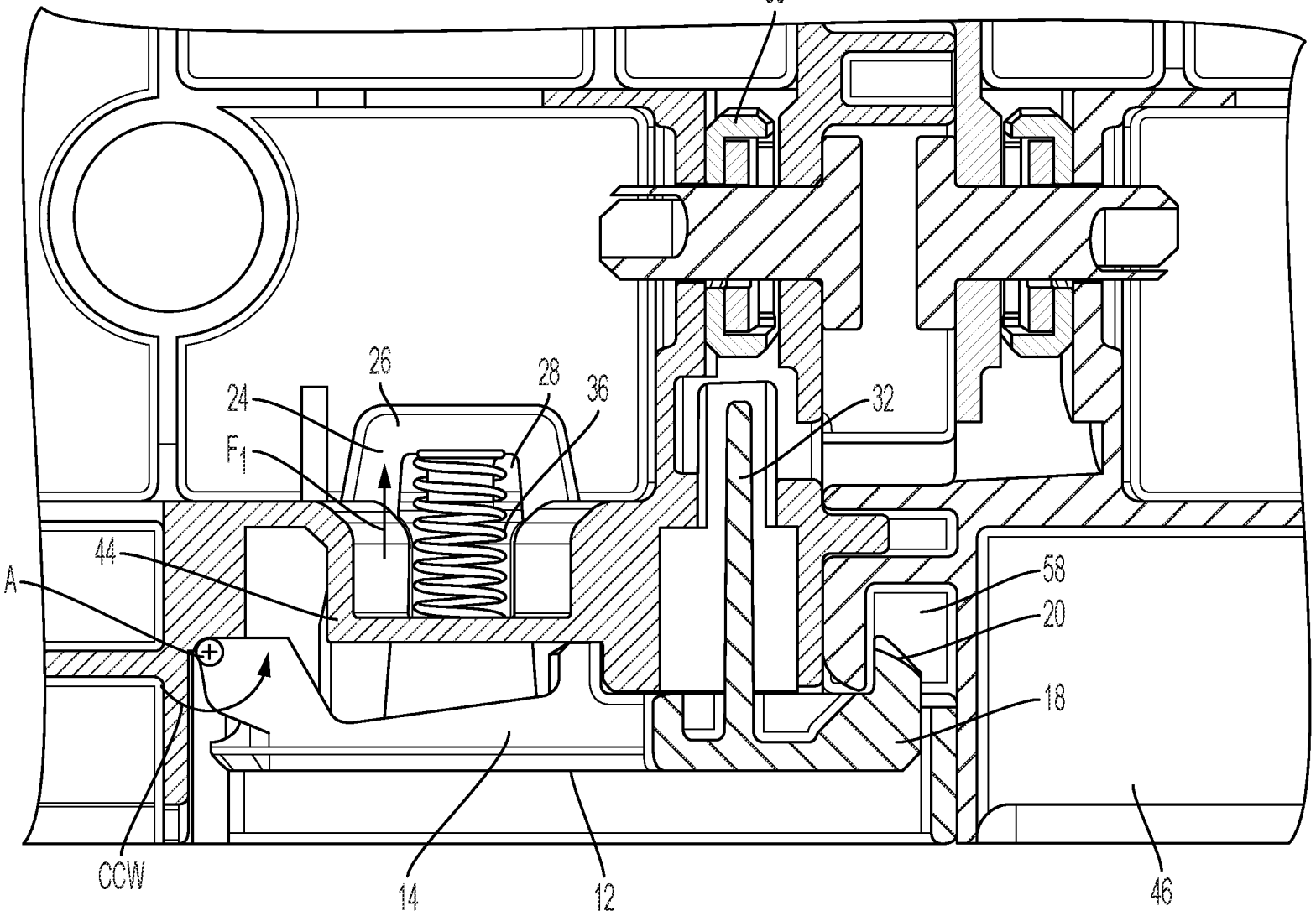
FIG. 7*a* is detailed view of an inset of FIG. 6 (rotated 180°) showing the automatic locking mechanism securing the worktable in its operable position.
Figure 7B:
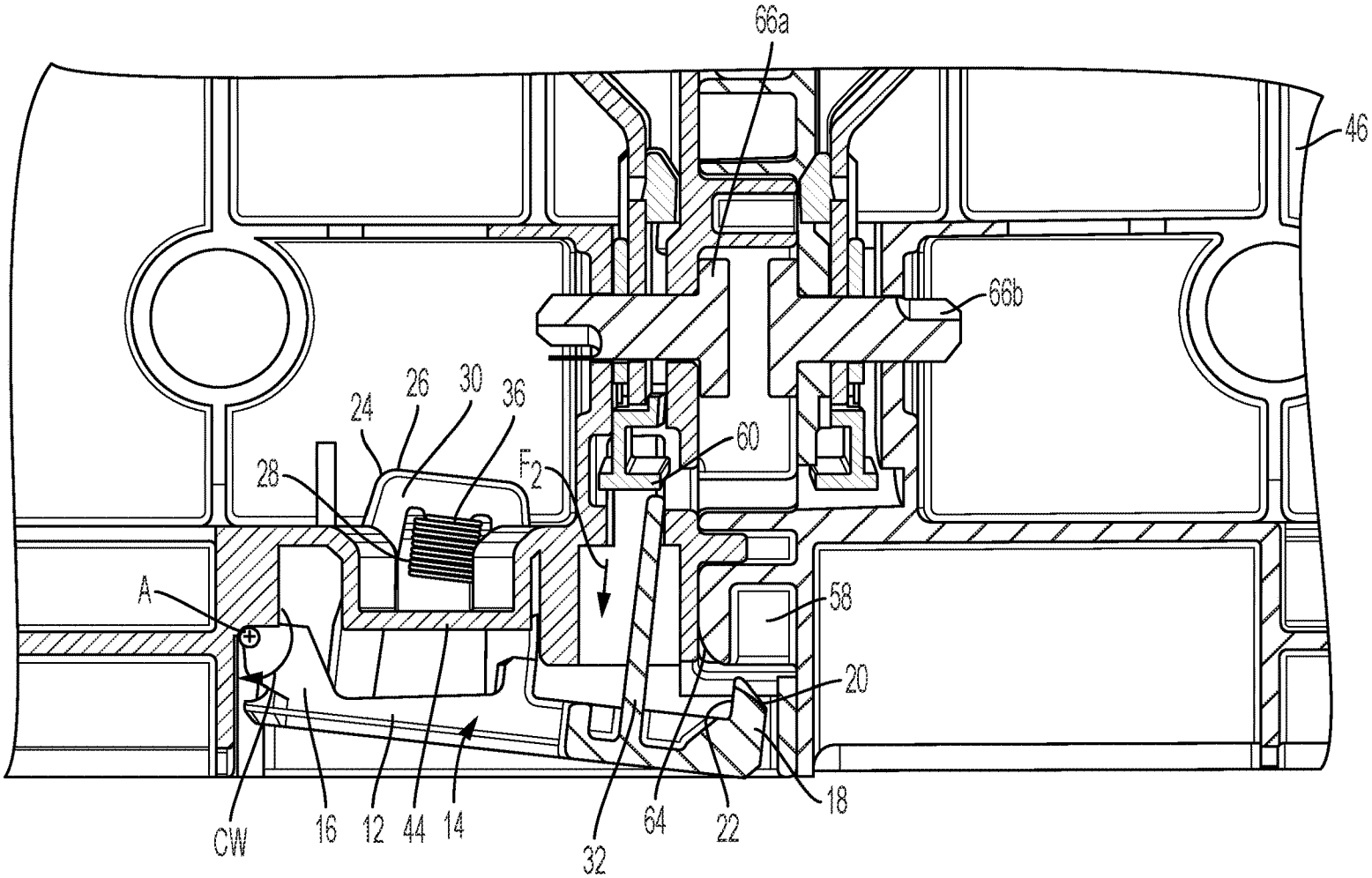
FIG. 7*b* is a detailed view of an inset of FIG. 6 showing the automatic locking mechanism releasing the worktable from its operable position.

As stated above, the automatic locking mechanism 10 also includes a biasing mechanism 36. As best seen in FIGS. 7*a* and 7*b*, biasing mechanism 36 is positioned in the space 28 between the first portion 44 and the interior apex 30 of the arch 26. Biasing mechanism 36 is configured to bias the latch 12 toward pivoting about the axis (A) in a second direction (CCW) that is opposite the first direction (CW). (For ease of reference, the second direction (CCW) will hereinafter be described in relationship to its positioning in FIG. 7*a*. However, those skilled in the art will recognize that in operation, the direction of rotation CW or CCW is dependent on the physical orientation of the worktable.) Those skilled in the art will recognize that the biasing mechanism can be a coil spring or a leaf spring.

INDUSTRIAL APPLICATION

Figure 2:
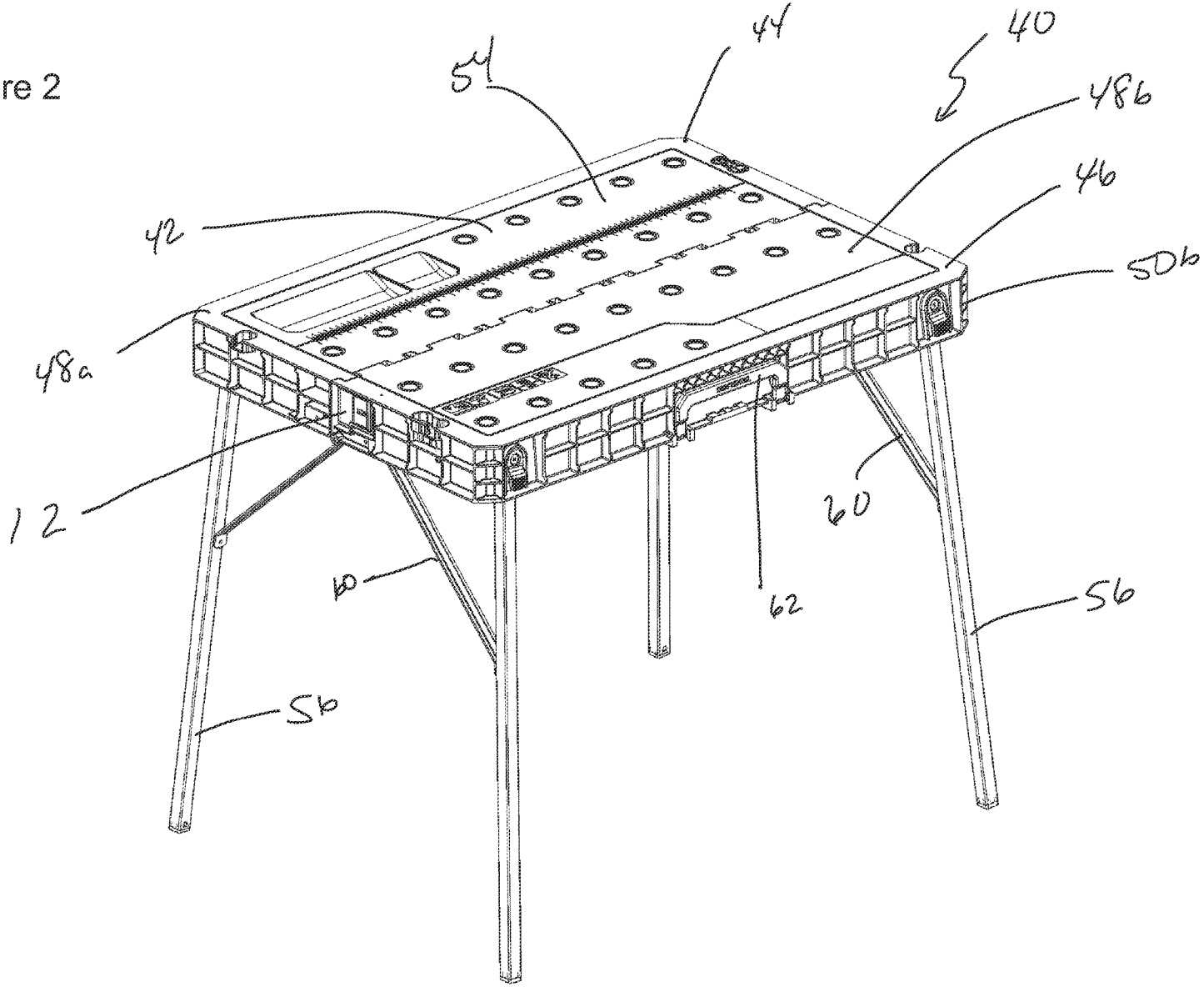
FIG. 2 is a perspective view of a fully deployed worktable with the automatic locking mechanism of FIG. 1.
Figure 4:
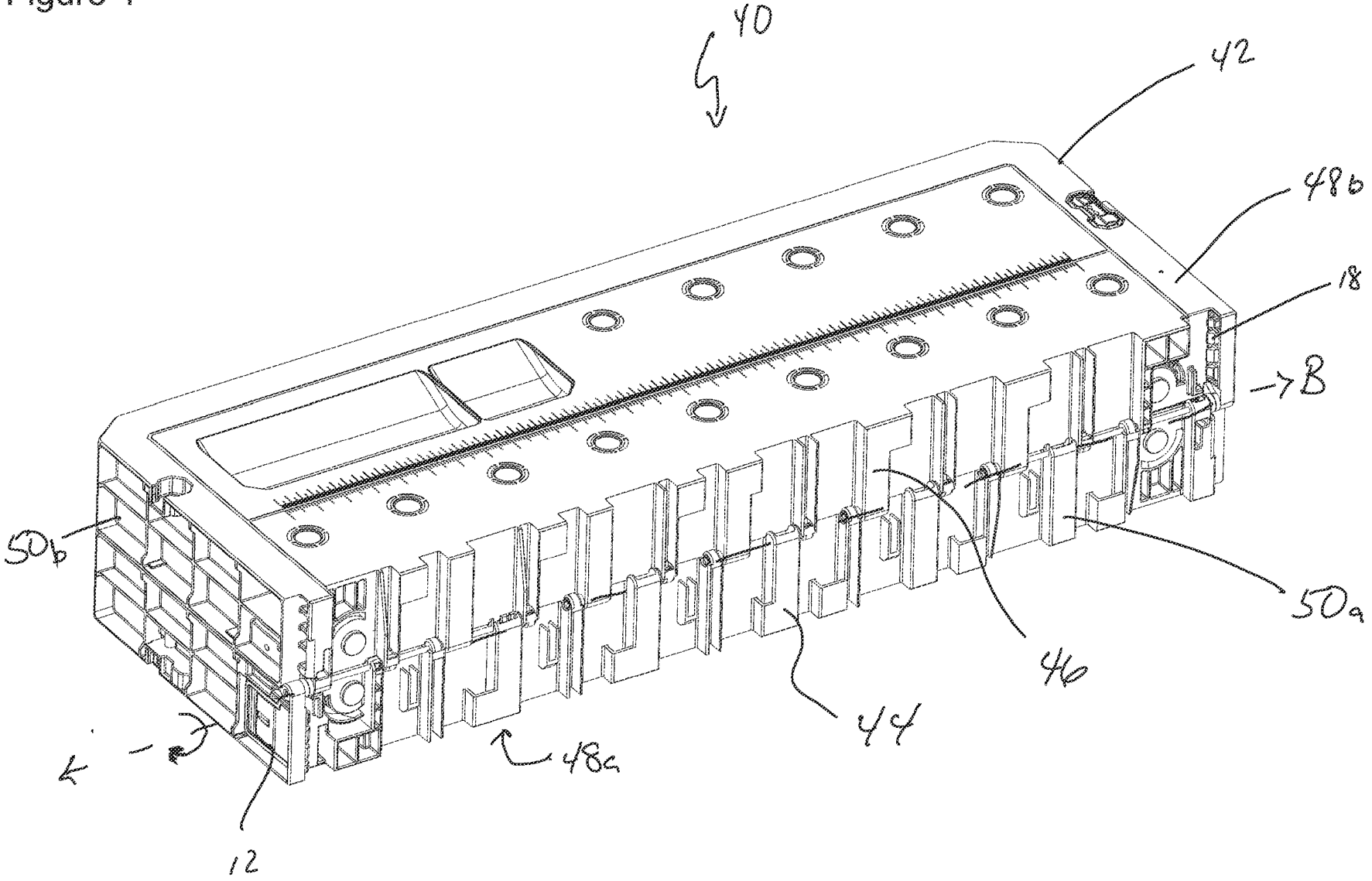
FIG. 4 is a perspective view of a folded worktable with the locking mechanism of FIG. 1.

The operation of the automatic locking mechanism 10 within worktable 40 will now be discussed. Worktable 40 is a portable worktable that can be easily transported and set up at a desired location. Typically, worktable 40 is transported while it is in its folded configuration. This configuration is best shown in FIG. 4. In this configuration, the first portion 44 and second portion 46 of worksurface 42 are folded about an axis (B) such that their tops 48*a*, 48*b* are parallel to one another and spaced apart by walls 50*a*, 50*b*. This is folded position of the worksurface 42. In this position, the respective tops 48*a* 48*b* and plurality of walls 50*a*, 50*b* are positioned to enclose an interior space 52. Those skilled in the art will recognize that interior space 52 is not enclosed with worksurface 42 is in its operable position. In this folded position, worktable 40 may be easily transported a handle 62. Handle 62 is best shown in FIG. 2.

Figure 5:
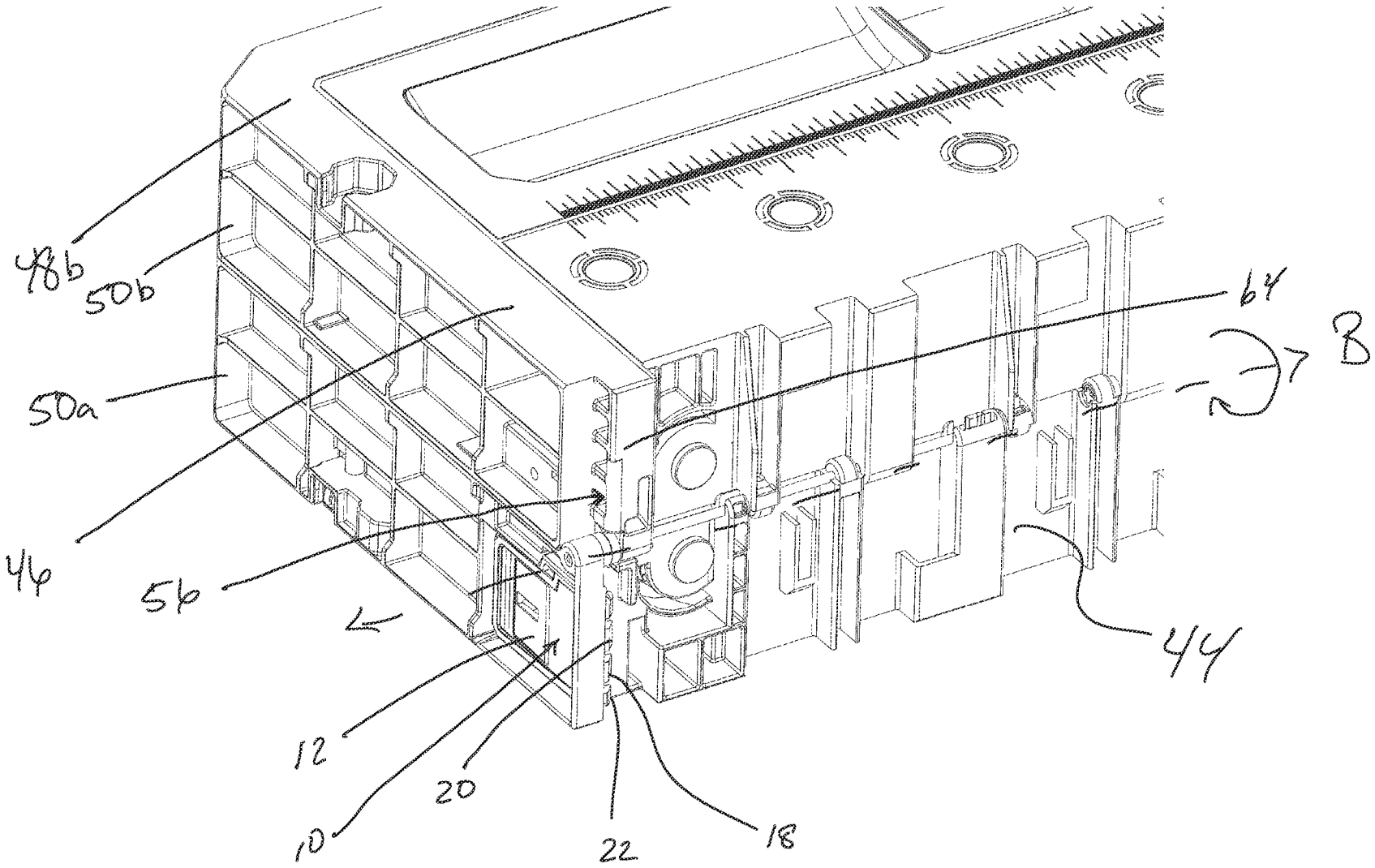
FIG. 5 is a detailed partial perspective view of a folded worktable with the locking mechanism of FIG. 1.

When an operator arrives at her desired location, she can set up the worktable 40 for use by first pivoting the first portion 44 and second portion 46 about axis (B) such that the respective tops 48*a*, 48*b* are positioned to form a single planar surface 54. This is the operable position of the worksurface 42. As the first and second portions 44, 46 are rotated into one another, the automatic locking mechanism 10 automatically secures said portions to one another. The features that achieve this function are best seen in FIG. 5, which shows a detailed perspective view of worktable 40 in its folded configuration. In this view, the automatic locking mechanism 10 is pivotally connected to the first portion 44. The second portion 46 includes a latch engaging surface 64. As the second portion 46 is rotated into proximity with the first portion 44, latch engaging surface 64 will come into contact with the securing portion 18 of latch 12. More specifically, latch engaging surface 64 will come into contact with the receiving surface 20 of the securing portion 10. When this occurs, latch 12 will be pivoted slightly about axis A in a first direction (CW). An example of this first direction (CW) movement can be seen in FIG. 7*b*. In a preferred embodiment, both the latch engaging surface 64 and the receiving surface 20 will be beveled. The beveled surfaces help to facilitate the slight pivoting of the latch 12 about axis (A).

The continued movement of the first portion 44 and second portion 46 about axis (B) will eventually cause the latch engaging surface 64 and the receiving surface 20 to clear one another. When this occurs, biasing mechanism 36 causes the hook 22 to automatically engage an opening 58 defined in second portion 46. More specifically, said opening 58 is defined in the latch engaging surface 64. When this occurs, the operator will hear a familiar "click" sound. Thus, letting her know that the worksurface 42 is securely locked in its operable position. Biasing member 36 is positioned between the first portion and the interior apex 30 of arch 26. Thus, biasing member is configured to apply a biasing force (F1) that biases latch 12 toward rotation about axis (A) in a second direction (CCW) that is opposite the first direction (CW). An example of force (F1) and the biased movement of latch 12 in the second direction (CCW) can best be seen in FIG. 7*a*.

With the worksurface 42 in its operable position, an operator can now pivot legs 56 from their stowed position into their support position. Worktable 40, which is now in its fully deployed position, can now be used to carry out various carpentry tasks. When said tasks are complete, the worktable 40 can be broken down and transported to another site. The breaking down of worktable 40 is enhanced in that the automatic locking mechanism 10 can automatically disengage the first portion 44 from the second portion 46 by simply stowing one of the legs 46.

Figure 3:
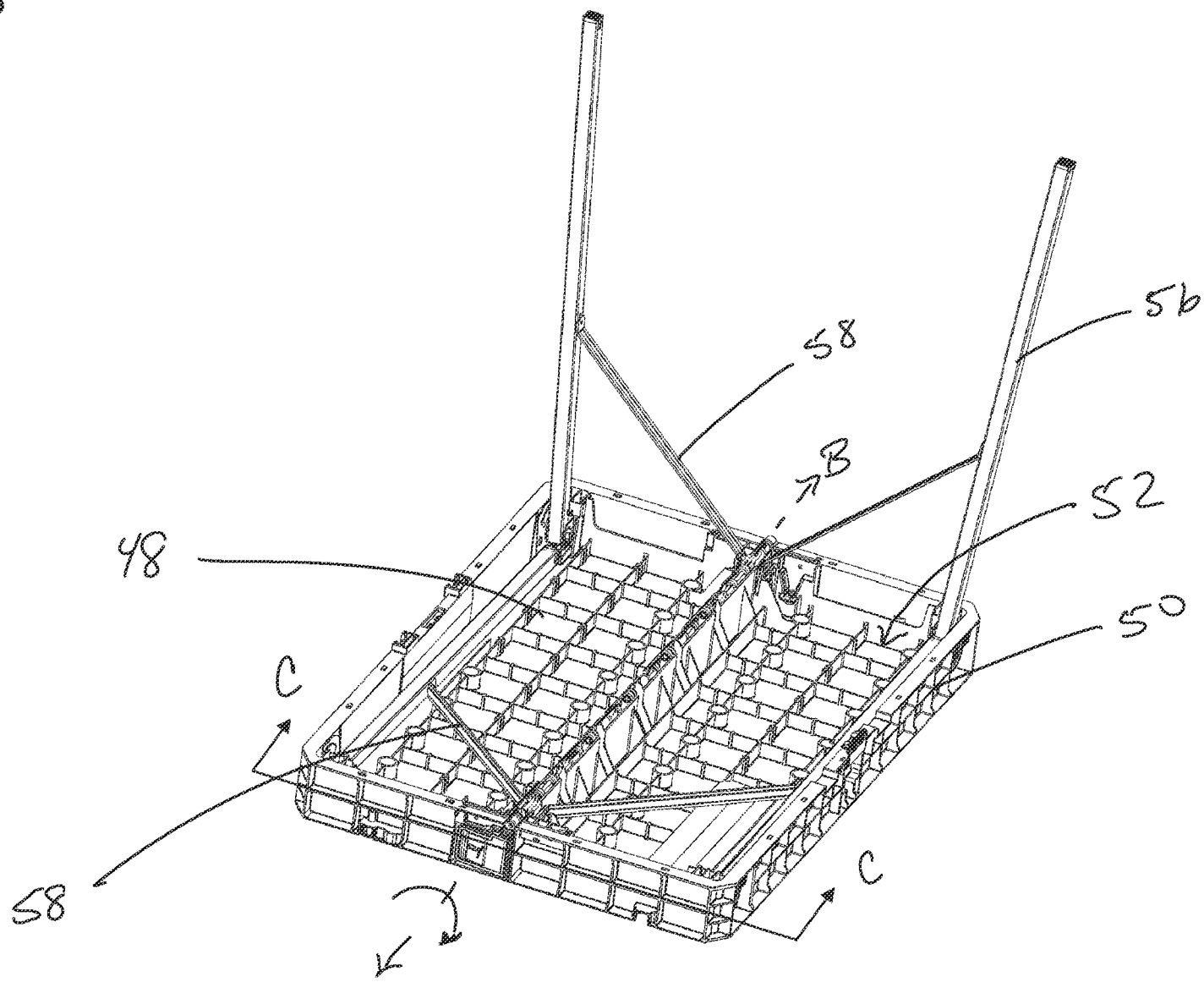
FIG. 3 is a perspective view of the bottom of a partially deployed worktable with the locking mechanism of FIG. 1.
Figure 6:
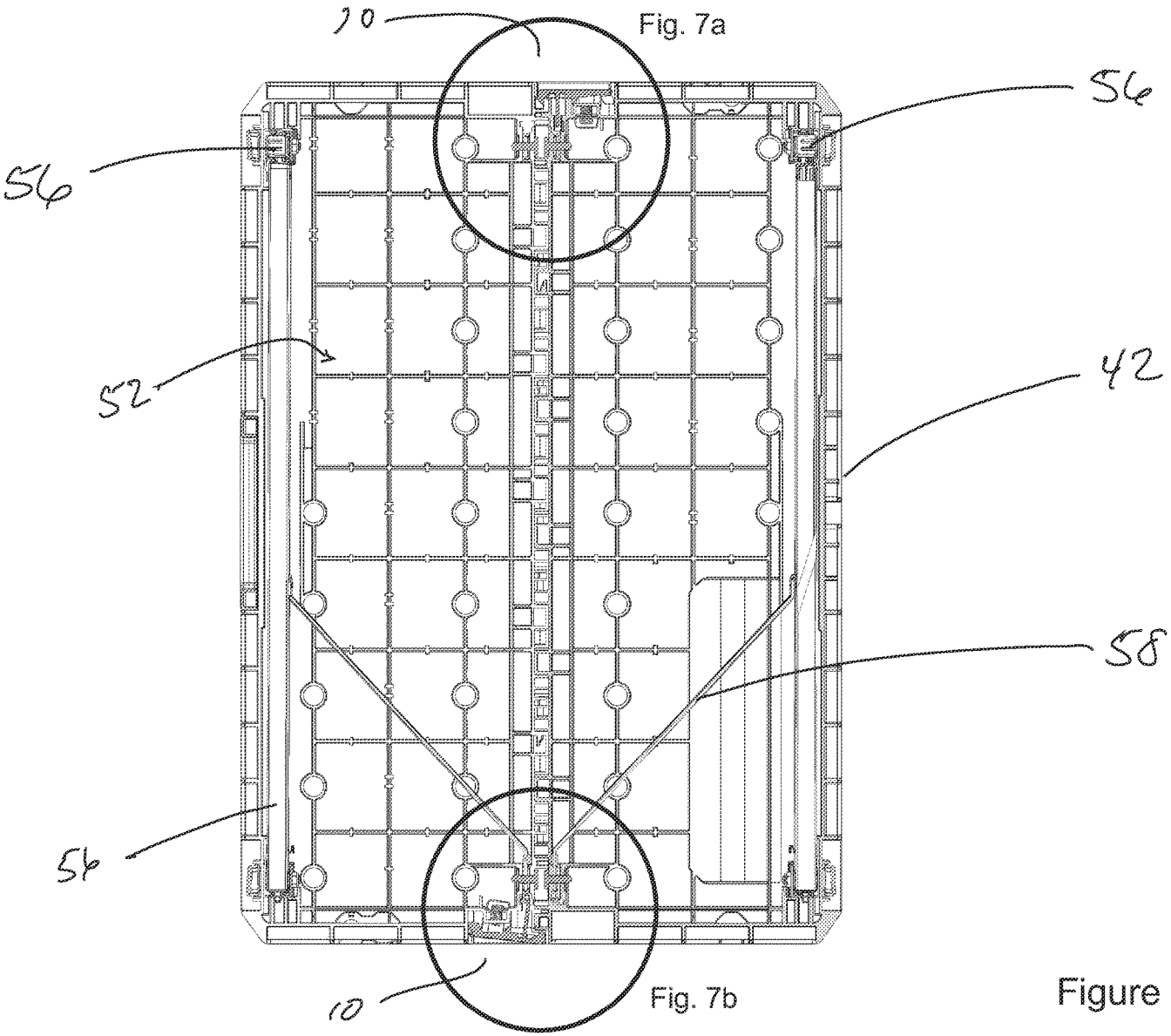
FIG. 6 is a plan cutaway view of a the partially deployed worktable of FIG. 3.

FIGS. 3 and 6 show a worktable 40 in a partially broken down state. Specifically, these figures show a worktable with two legs 56 in their support position, and two legs 56 in their stowed position. FIG. 6, which is a cutaway view of a worktable 40 in the partially broken down state shows how the position of legs 56 affect the operation of the automatic locking mechanism 10. Inset 7*a* at the top of FIG. 6 shows the position of the automatic locking mechanism 10 with the legs 56 of the worktable 40 in their support position. In this position, the automatic locking mechanism is in its fully locked position, wherein the first and second portions 44, 46 are secured to one another such that worksurface 42 is a single planar surface 54. Inset 7*b* at the bottom of FIG. 6 shows the position of automatic locking mechanism 10 with the legs 56 of the worktable 40 in their stowed position. In this position, the automatic locking mechanism 10 is in its unlocked state, wherein the first and second portions 44, 46 may be separated from one another by rotation about axis (B). Those skilled in the art will recognize that the two automatic locking mechanisms of FIG. 6 are mirror images of one another. However, FIG. 7*a* is rotated 180° to allow for ease of reference and comparison to FIG. 7*b*.

Starting from FIG. 7*a*, when an operator desires to break down her worktable 40, she may selectively move a leg 56 from its support position to its stowed position. Those skilled in the art will recognize that legs 56 may be pivotally secured to the first and second portions 44, 46 about pins 66*a*, 66*b*. As can be seen in FIG. 7*b*, in a preferred embodiment, legs 56 may further include crossbars 60. As crossbar 60 rotates about pin 60*a*, it engages the cam structure 32. More specifically, crossbar 60 engages the receiving surface 34 of cam structure 32. In a preferred embodiment, the receiving surface 34 may be beveled. When crossbar 60 engages the receiving surface 34, a force (F2) is applied to the cam structure 32, which causes latch 12 to pivot about axis (A) in the first direction (CW). This rotation of latch 12 about axis (A) in the first direction (CW) causes the hook 22 of latch 14 to disengage from the opening 58. Thus, the first portion 44 and second portion 46 are no longer secured to one another. In this way, the automatic locking mechanism 10 is able to be disengaged via a single step. Moreover, as the movement of stowing a leg 56 is a required step in order to break down the worktable, the disengaging of the automatic locking mechanism 10 is achieved more efficiently. Those skilled in the art will recognize that the movement of leg 56 into it stowed position also compresses biasing mechanism 36. (See FIG. 7*b*). This compression stores energy in the biasing mechanism 36 such that when an operator arrives at a new site and desires to set the worktable 40 back into its operational state, rotation of the leg 56 into its support position will release said energy such that the latch 40 will rotate back in the second direction (CCW). With the latch 12 of the automatic locking mechanism 10 in its original position, worktable is ready to be deployed again.

It should be understood that although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the claims.

The invention claimed is:

1. An automatic locking mechanism configured to automatically secure a first object to a second object when said first and second objects are adjacent one another, and to selectively release said first and second objects from one another in response to the movement of a third object, said automatic locking mechanism comprising:

a latch comprising:

a base;

a pivoting portion attached to the base and configured to pivotally secure the latch to the first object about an axis;

a securing portion attached to the base and comprising a receiving surface being configured to contact the second object as it comes into proximity with the first object and pivot the latch about axis in a first direction, and wherein said securing portion further comprises a hook configured to automatically secure the second object to the first object when said objects are adjacent to one another;

a bias support attached to the base and comprising an arch that is configured to protrude into the first object and define a space between the first object and an interior apex of the arch; and a cam structure attached to the base and comprising a receiving surface being configured to contact the third object and pivot the latch about axis in the first direction in response to the selective movement of the third object; and a biasing mechanism positioned in the space between the first object and the interior apex of the arch, and wherein said biasing mechanism is configured to bias the latch toward pivoting about the axis in a second direction that is opposite the first direction, and wherein said bias support further comprises a bias guide configured to engage the biasing mechanism and guide its biasing function.

2. The automatic locking mechanism of claim 1, wherein the receiving surface of the securing portion is a beveled surface.

3. The automatic locking mechanism of claim 1, wherein the receiving surface of said cam structure is a beveled surface.

4. The automatic locking mechanism of claim 1, wherein the biasing mechanism is a coil spring or leaf spring.

5. A worktable comprising:

a worksurface having a first portion and second portion each having a top and a plurality of walls that are substantially perpendicular to the top, and wherein the first portion and second portions are pivotally connected to one another about an axis such that the worksurface is movable between a folded position, wherein the respective tops and plurality of walls are positioned to define an interior space, and an operable position, wherein the respective tops are positioned to form a single planar surface;

a plurality of legs, wherein each leg is movable between a support position, wherein said leg provides support for the worksurface in its operable position, and a stowed position, wherein said leg is confined within the interior space; and characterized in that the worktable further includes a latch configured to automatically secure the first portion and second portion together when the worksurface is pivoted into its operable position, and automatically release the first portion and second portion from one another in response to the movement of at least one leg from its support position to its stowed position, said latch comprising:

a base;

a pivoting portion attached to the base and configured to pivotally secure the latch to the first portion about an axis;

a securing portion attached to the base and comprising a receiving surface being configured to contact the second portion as it comes into proximity with the first portion and pivot the latch about axis in a first direction, and wherein said securing portion further comprises a hook configured to automatically secure the second portion to the first portion when the worksurface is in its operable position;

a bias support attached to the base and comprising an arch that is configured to protrude into the first portion and define a space between the first portion and an interior apex of the arch; and a cam structure attached to the base and comprising a receiving surface being configured to contact a leg and pivot the latch about axis in the first direction in response to the movement of the leg from its support position to its stowed position; and a biasing mechanism positioned in the space between the first portion and the interior apex of the arch, and wherein said biasing mechanism is configured to bias the latch toward pivoting about the axis in a second direction that is opposite the first direction, wherein, the bias support further comprises a bias guide configured to engage the biasing mechanism and guide its biasing function.

6. The worktable of claim 5, wherein the hook secures the second portion to the first portion by engaging an opening defined in the second portion.

7. The worktable of claim 5, wherein the receiving surface of the securing portion is a beveled surface.

8. The worktable of claim 5, wherein the receiving surface of said cam structure is a beveled surface.

9. The worktable of claim 5, wherein the biasing mechanism is a coil spring or leaf spring.

10. The worktable of claim 5, wherein the at least one leg includes a cross bar and said cross bar is configured to engage the cam structure of the latch when said leg is moved from its support position to its stowed position.

11. The worktable of claim 5, further comprising a handle configured to facilitate transportation of the worktable when the legs are in their stowed position and the worksurface is in the folded position.

12. A worktable comprising:

a first portion having a first top surface and second portion having a second top surface, said first portion and said second portion pivotally connected to one another about an axis between a folded position and an operable position wherein in said operable position said first top surface and said second top surface are positioned to form a single planar worksurface, said second portion including an engaging surface with an opening defined in said second portion behind said engaging surface;

a first leg and a second leg movable between a support position in which each leg provides support for the worksurface in its operable position, and a stowed position in which said first leg is folded beneath said first portion and said second leg is folded beneath said second portion; and a latch, said latch including:

a base pivotably secured to said first portion about an axis said base including a receiving surface and a hook each extending from one surface of said base an arch having an interior apex and extending from said one surface of said base, a space defined between said first portion and said interior apex, and a cam extending from said one surface of said base and comprising a cam receiving surface, said hook and said cam each extending in the same direction from said one surface of said base;

a spring positioned in the space and disposed to bias the latch so as to pivot about the axis in a direction which causes said hook to move towards said first portion; wherein, when said first portion and said second portion are pivoted to said operable position, said second portion engaging surface engages said hook to cause said hook to pivot against the spring bias away from said first portion until said engaging surfaces passes over said hook and engages in said opening; and wherein, when said first portion and said second portion are pivoted to the folded position at least one said leg contacts said cam to pivot the latch away from said first portion until said hook is moved out of the opening and is clear of said engaging support position.

13. The worktable recited in claim 12, said arch extending in the same direction from said one surface as said hook and said cam.

14. The worktable recited in claim 13, said cam and said arch extending substantially perpendicular to each other.

15. The worktable recited in claim 12, said cam and said arch extending substantially perpendicular to each other.

* * * * *